United States Patent [19]

Capozziello et al.

[11] 4,254,867

[45] Mar. 10, 1981

[54] PACKAGE AND METHOD FOR TRANSPORTING LOOSE BRICK

[76] Inventors: Leonard J. Capozziello; David J. Capozziello, both of 77 Palm St., Bridgeport, Conn. 06610

[21] Appl. No.: 53,368

[22] Filed: Jun. 29, 1979

[51] Int. Cl.[3] ..... B65D 85/46; B65D 63/02; B65D 19/00

[52] U.S. Cl. ..... 206/322; 206/386; 206/597

[58] Field of Search ..... 206/322, 321, 386, 597; 229/87 R

[56] References Cited

U.S. PATENT DOCUMENTS

| | | | |
|---|---|---|---|
| 1,922,560 | 8/1933 | Sullivan | 206/322 |
| 2,340,422 | 1/1944 | Okonski | 206/321 |
| 3,118,536 | 1/1964 | Allen | 206/322 |
| 3,473,647 | 10/1969 | Leff | 206/322 |

*Primary Examiner*—William T. Dixson, Jr.
*Attorney, Agent, or Firm*—Alfred E. Miller

[57] ABSTRACT

A palletized brick package for transporting loose, new or used brick, to a construction site, or other places where brick is used or sold. A support sheet is placed on the pallet and the bricks are arranged in rows, some of which constitute different patterns to form a rectangular shaped assembly of loose bricks stacked juxtaposed to each other. A rigid, somewhat flexible sheet is placed around the brick assembly having strong but flexible bands encircling said exterior sheets, thereby encasing said bricks to securely hold the brick package together even upon loading and unloading the bricks by means of forklift trucks or the like. Each of the brick packages constitute rows of bricks stacked preferably five high for easy handling, and minimum breakage.

7 Claims, 4 Drawing Figures

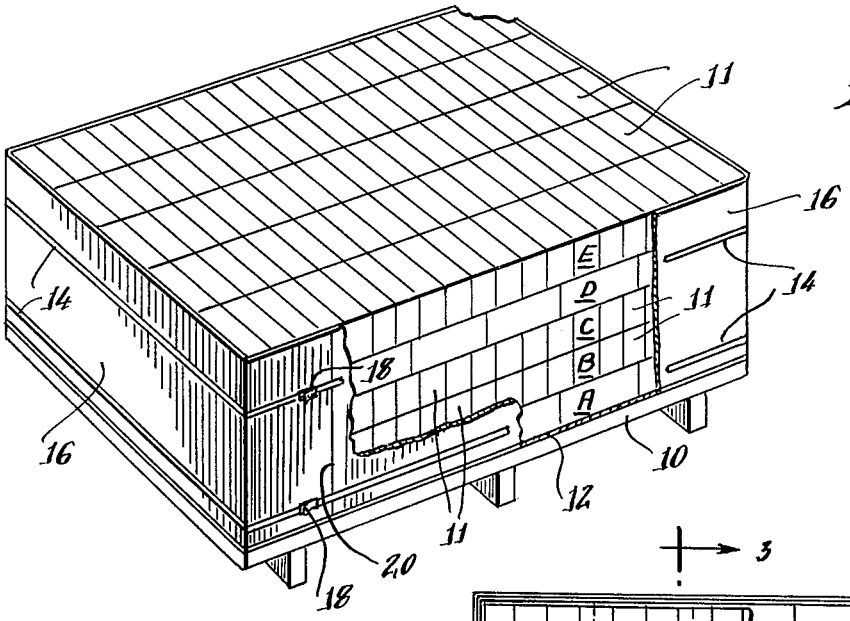
Fig. 1.
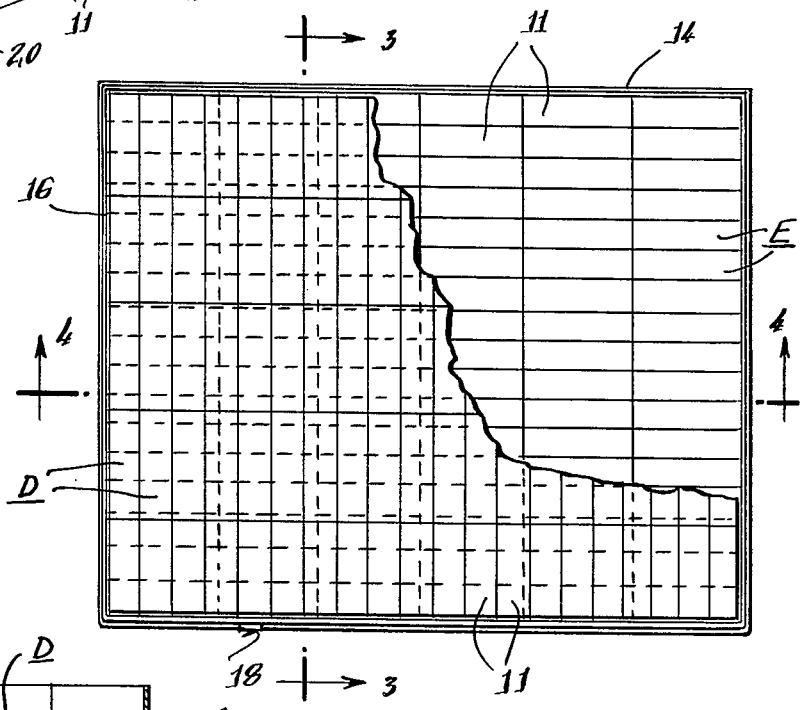
Fig. 2.
Fig. 3
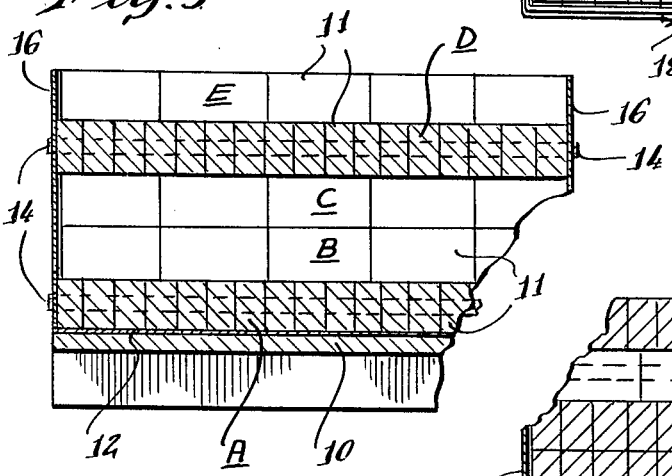
Fig. 4.
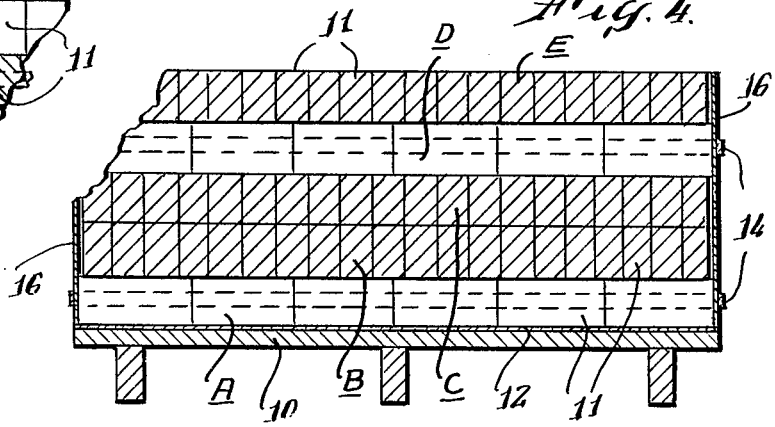

PACKAGE AND METHOD FOR TRANSPORTING LOOSE BRICK

BACKGROUND OF THE INVENTION

In the past, loose brick being shipped from one location to another were merely piled in dump trucks or on pallets on flatbed trailers, and transported in that manner. Obviously, many bricks were broken as a result of a haphazard assembly of the bricks for transport. In addition, many bricks fell off the pallets, and were either lost or chipped.

This invention has been devised in order to overcome the present unsatisfactory methods of transportation of loose bricks. The present invention is particularly important since the cost of manufacture and transport of bricks is rapidly escalating. It is therefore an object of the present invention to provide a method and a package for brick assembly that is easily and rapidly utilized, and in which the intended results are consistently achieved.

It is a further object of the present invention wherein the flexible sheet encircling the brick package is fabricated of a weather-resistant material, such as treated cardboard, as well as other suitable materials.

It is a further object of the present invention to supply a frictional surface for said brick package in the form of a flat sheet deposited on the pallet prior to assembly of the bricks thereon.

And still another object of the present invention is to provide a brick package which is secured by a flexible sheet having metal or plastic bands or the like, in such a manner that the individual bricks in each package will not shift, even when being transported for considerable distances by vehicle.

In order that the invention will be more clearly understood, it will now be disclosed in greater detail with reference to the accompanying drawings, in which:

FIG. 1 is a perspective view of the palletized package for the transporting of loose brick constructed in accordance with the teachings of our invention;

FIG. 2 is a top plan view of the arrangement shown in FIG. 1 in which part of the top layer of bricks is broken away to show the orientation of the layer below the top;

FIG. 3 is a fragmentary sectional view taken along the lines 3—3 of FIG. 2; and FIG. 4 is a fragmentary sectional view taken along the lines 4—4 of FIG. 2.

DESCRIPTION OF THE PREFERRED EMBODIMENT

Referring to FIG. 1, a well-known pallet 10 is utilized in the present invention, however it is preferred to employ a pallet having a length dimension of 48 inches, and a width dimension of 40 inches. As seen in FIG. 4, a rigid sheet 12 of cardboard, plywood, plastic, or the like, is placed on the load-supporting surface of the pallet. This surface is usually in the form of spaced planking and the sheet 12 prevents the brick being stacked on the pallet from falling through the spaces between the planks, as well as providing a flat base for the bricks to be stacked. The bricks referred to generally by the reference numeral 11 are stacked in a special way in order to form a symmetrical, rectangular-shaped brick package. In the package shown in FIG. 1, there are five rows of bricks A, B, C, D and E. It is to be understood that it is within the teachings of the present invention to provide less or more rows of bricks, as long as there are at least two rows. As seen in FIGS. 1 and 4, rows B, C and E have five bricks across the front arranged 20 rows deep, while rows A and D have 17 bricks across the front arranged six rows deep. Thus, each of rows B, C and E have 100 bricks, while rows A and D have 102 bricks each. The entire brick package constitutes 504 bricks.

It will be noted from FIG. 3 that rows A and D protrude slightly beyond the end of rows B, C and E. Therefore, flexible but rigid straps 14 fabricated of metal or plastic encircle rows A and D, and tightly bind these rows of bricks having a flexible sheet 16 therebetween.

Each of the straps 14 is provided with a securing clip 18. Thus, each of the bands 14 are made endless and are secured by the clips 18 located adjacent to the ends 20 of the flexible sheet 16. When completed, the brick package is formed of symmetrical rows of bricks in a rectangular package that is easily handled by a forklift truck, or other lifting or carrying means. It is also to be understood that although six rows of bricks are shown, more or less rows of bricks can be used in a brick package within the spirit and scope of the present invention, providing there are at least two rows.

It is preferred that the sheet 16 be fabricated of a weather resistant cardboard or plastic, the latter being flexible, however, having sufficient rigidity to form a rectangular outer covering for the brick package.

The brick package is assembled in the following steps: a pallet is provided preferably having dimensions of 40 by 48 inches. A rectangular sheet is placed on the top surface of the pallet providing a frictional surface for the laying of bricks thereon, as well as preventing the shifting of the bricks when the package is assembled, and preventing bricks from dropping through the pallet slats. The first row of bricks is laid on the sheet 12, having 6 bricks across and 17 rows deep thereby making 102 bricks. Thereafter, the second and third rows are placed superposed on each other, each having 20 bricks across and five rows deep, and each making 100 bricks. The fourth row is laid with 6 bricks across and 17 rows deep making 102 bricks. Finally, the top row is laid on the fourth row with 20 bricks across, and 5 rows deep, making 100 bricks. Thus, the total brick package constitutes 504 bricks. A flexible sheet 16 of cardboard or the like is then placed around the brick assembly to form a brick package. The sheet may be in the form of cardboard, tar paper, plastic or the like, and the material thereof should be rated approximately 270 lb. test. Finally, the bands 14 are placed around the brick package encircling the first and fourth rows, and tightly engaging the flexible sheet to maintain the bricks in a compact and secure package. This package is easily and rapidly handled, and the bricks damaged or broken are reduced to a very small amount, if any.

What is claimed is:

1. A combination pallet and package for transporting loose brick comprising: a flat frictional sheet on said pallet, a plurality of superposed rows of loose brick stacked juxtaposed to each other on said flat sheet at least one of said rows having more bricks than another row whereby at least two edges of said row projects beyond the corresponding edges of said other row, a stiff but bendable sheet encircling the exposed edges of said bricks, a pair of flexible straps each being placed around the outside surfaces of said bendable sheet juxtaposed to said first and fourth row of bricks, and securing means for said strap which draws said strap in an endless loop in tight engagement with said outside surfaces of said bendable sheet to form a compact and secure brick package.

2. A combination pallet and package for transporting loose brick as set forth in claim 1 wherein there are five rows and each of said other rows have 100 bricks, while said first and fourth rows have 102 bricks so that the bricks on opposite ends of the first and fourth row of bricks project beyond the edges of the other rows of bricks.

3. A combination pallet and package for transporting loose brick as set forth in claim 1 wherein said bendable sheet is cardboard having high strength characteristics.

4. A combination pallet and package for transporting loose brick as set forth in claim 1 wherein said flat sheet is substantially the same size as the top of said pallet and is cardboard.

5. A method of packaging a plurality of loose brick for transporting on a pallet comprising: placing a flat sheet on said pallet, stacking a multiplicity of loose brick juxtaposed to each other in a series of rows on said flat sheet to form a first level, stacking a multiplicity of loose brick juxtaposed to each other in a series of rows superposed on said first level to form a second level, and each of said bricks on said second level having a different orientation from each of said bricks on the first level, stacking loose brick to form third, fourth and fifth superposed levels, bending a stiff but relatively flexible sheet about the exposed edges of said bricks on said first and second levels, rigidly holding said loose brick in a package by placing flexible straps around said flexible sheet juxtaposed to said first and fourth levels, and drawing said straps tight against an outer surface of said flexible sheet, and securing means on said flexible strips for tightly maintaining said brick package.

6. A method of packaging a plurality of loose brick for transporting on a pallet as claimed in claim 5 wherein said first and fourth levels have more bricks than said second, third and fifth levels.

7. A method of packaging a plurality of loose brick for transporting on a pallet as claimed in claim 6 wherein said first and fourth levels are oriented at right angles to said second, third and fifth levels.

* * * * *